United States Patent [19]

Hinrichs et al.

[11] Patent Number: 4,536,938

[45] Date of Patent: Aug. 27, 1985

[54] PROCESS FOR THE CONTINUOUS PRODUCTION OF SOLID ALKALI METAL STRANDS

[75] Inventors: Walter Hinrichs, Brühl; Friedrich Hammer, Frechen-Habbelrath; Ludwig Lange, Brühl, all of Fed. Rep. of Germany

[73] Assignee: Degussa Aktiengesellschaft, Frankfurt am Main, Fed. Rep. of Germany

[21] Appl. No.: 255,512

[22] Filed: Apr. 17, 1981

[30] Foreign Application Priority Data

Apr. 26, 1980 [DE] Fed. Rep. of Germany ..... 3016173

[51] Int. Cl.[3] ..... B22D 11/126; B21C 23/00

[52] U.S. Cl. ..... 29/527.5; 29/527.6; 72/259

[58] Field of Search ..... 29/527.6, 2, 8, 527.5, 29/527.6; 75/66; 72/259

[56] References Cited

U.S. PATENT DOCUMENTS

| | | | |
|---|---|---|---|
| 1,567,363 | 12/1925 | Elrod et al. | 164/281 |
| 2,205,865 | 6/1940 | Schwarzkopf | 75/122 |
| 2,225,424 | 12/1940 | Schwarzkopf | 75/122 |
| 3,600,155 | 8/1971 | De Vries et al. | 75/66 |
| 3,634,067 | 1/1972 | Klein | 75/66 |
| 3,874,207 | 4/1975 | Lemelson | 72/56 |

FOREIGN PATENT DOCUMENTS

| | | | |
|---|---|---|---|
| 1458031 | 10/1971 | Fed. Rep. of Germany . | |
| 2302175 | 5/1974 | Fed. Rep. of Germany . | |
| 2457423 | 6/1976 | Fed. Rep. of Germany . | |
| 457838 | 12/1936 | United Kingdom | 72/259 |
| 1236233 | 6/1971 | United Kingdom . | |
| 1427044 | 3/1976 | United Kingdom . | |
| 1478822 | 7/1977 | United Kingdom . | |
| 1546498 | 5/1979 | United Kingdom . | |

OTHER PUBLICATIONS

"Handbuch des Stranggiessens", Herrman, 1958, pp. 764–765.

"Modern Plastics Encyclopedia", 1977–1978, pp. 727–729.

*Primary Examiner*—Howard N. Goldberg
*Assistant Examiner*—Vernon K. Rising
*Attorney, Agent, or Firm*—Beveridge, DeGrandi & Weilacher

[57] ABSTRACT

A process is described for the production of solid alkali metal strands, whereby molten alkali metal is introduced to an extrusion apparatus and is continuously cooled down as the metal travels along a section of the extrusion apparatus by means of a worm. There is a temperature gradient between the point at which the molten alkali metal enters the extruder down to a temperature below its solidification point near the nozzle, at which the metal is still sufficiently ductile for extrusion, and is then fed to a nozzle for shaping into the stands.

6 Claims, 1 Drawing Figure

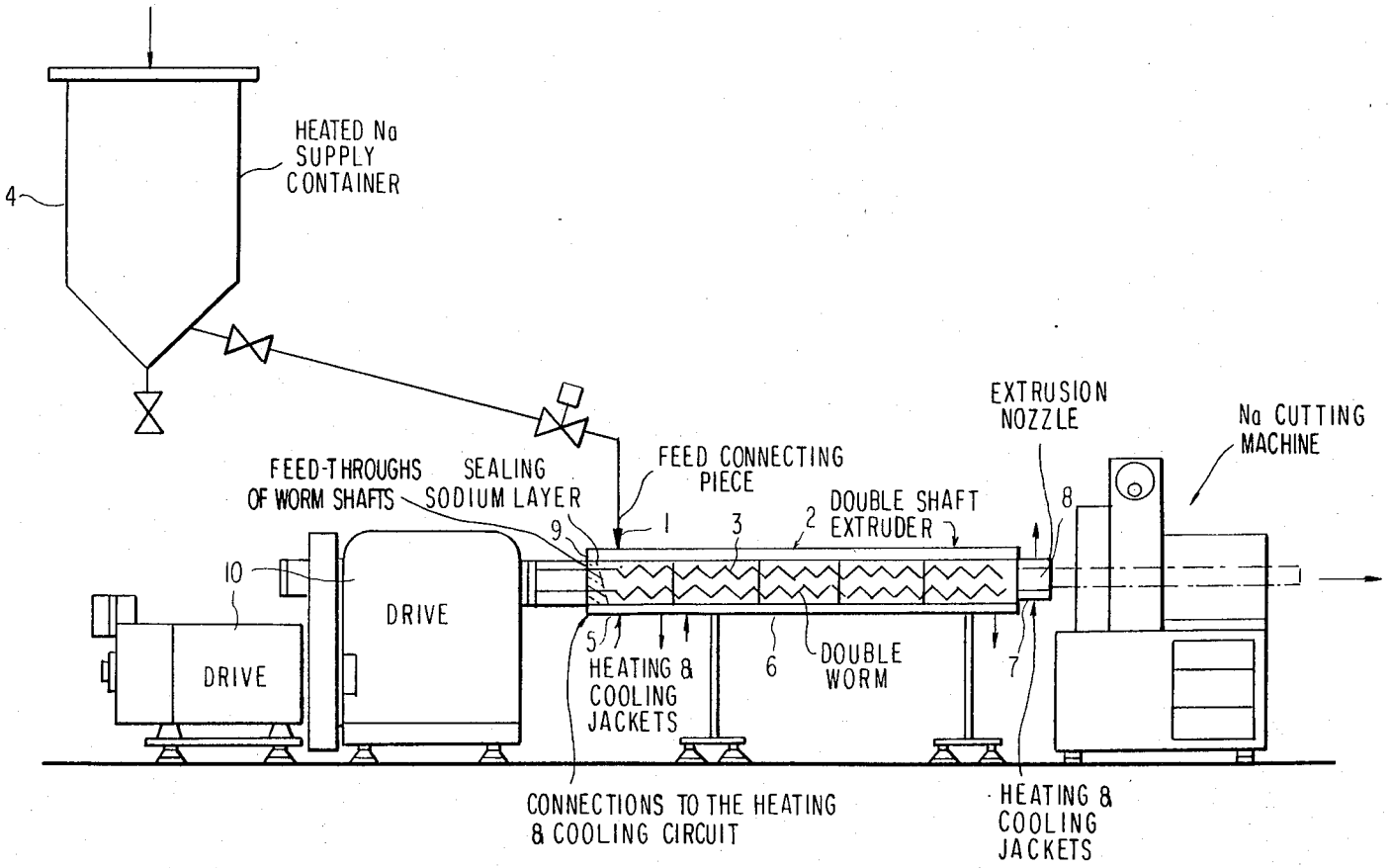
Na CUTTING MACHINE
EXTRUSION NOZZLE
8
7
HEATING & COOLING JACKETS
DOUBLE SHAFT EXTRUDER
2
DOUBLE WORM
6
FEED CONNECTING PIECE
3
1
HEATING & COOLING JACKETS
5
CONNECTIONS TO THE HEATING & COOLING CIRCUIT
9
SEALING SODIUM LAYER
FEED-THROUGHS OF WORM SHAFTS
DRIVE
10
DRIVE
HEATED Na SUPPLY CONTAINER
4

PROCESS FOR THE CONTINUOUS PRODUCTION OF SOLID ALKALI METAL STRANDS

Alkali metals for their processing are placed on the market to a considerable extent as shaped pieces of variable weight and variable dimensions. The shaped pieces are produced mainly by casting of the liquid metals. In addition thereto, alkali metals, particularly sodium, are also processed by pressing in the solid state into various shaped strands.

These methods of production have certain disadvantages. The most serious disadvantage is the formation of impurities through reaction of the metal with air and the steam contained in it. Furthermore, the high pressure required for pressing the solid metal in express, results in high wear of the material press. The pressing of the solid alkali metals is possible only in a discontinuous manner. As a result, the capacities of the machines are necessarily limited. The labor costs is high in relation to mill performance.

The above-mentioned disadvantages will be avoided by the following described process of the invention for the production of solid alkali metal strands. It is characterized by the fact, that molten alkali metal is cooled continuously in a single processing step to a temperature below its melting point, at which temperature the metal is still sufficiently ductile for an extrusion and is fed to a nozzle for shaping.

A particularly desirable embodiment of the process provides for cooling and shaping to be carried out simultaneously in a two shaft extruder. At the same time, one should proceed effectively by preheating the extruder at first to a temperature above the melting point of the metal and by subsequently adding liquid alkali metal from a heated container, until the latter emerges from the nozzle, and thereupon, while maintaining the flow of metal, cooling the extruder with a decreasing temperature gradient over its entire length, so that the metal at the nozzle reaches a temperature below its melting point. The process will operate with flexibility and safety whenever the frictional heat developing in the nozzle is dispersed independently from the heat removed from the balance of the extruder. This is accomplished best by a separate cooling jacket placed around the nozzle arrangement, with independent supply of coolant.

According to another advantageous embodiment of the process, sealing of the inside of the extruder against the ambient air, which is necessary because of the high reactivity of the alkali metals, is brought about by cooling the lead-through openings for the shaft of the extruder on the driving side, in order to provide a sealing layer of alkali metal inside the extruder at the openings for the shaft throughputs. The inside space of the extruder may be flushed during operation with an inert gas, such as $N_2$.

The shaped alkali metal may then, possibly under protective gas, be fed to an automatic cutting device and may be subdivided into shaped pieces, suitable for packaging.

In practice, one will proceed for the continuous production of, par example, solid strands of sodium, as is set forth hereinafter in connection with the accompanying drawing:

Molten sodium at a temperature of about 20° C. above its melting point is fed from a heated supply container 4 to the feed spout 1 of a two shaft extruder 2 with side by side located horizontal worms 3, running in the same direction and being in mesh. The extruder has several heating and cooling jackets 5, 6 and 7. The first jacket 5 is disposed in front of the feed spout 1 in the area of the shaft lead-through of the worms 9 for driving by drive 10. The second jacket 6 follows the first cooling jacket 5 and runs along the worm housing up to the extrusion nozzle 8. The latter is surrounded by a third jacket 7. Each heating or cooling jacket may be fed a heat transmitting medium independently of the other, which may be heated or cooled. When starting the extruder, it is first preheated over its entire length to about 120° C. Then a continuous flow through of alkali metal is adjusted until liquid metal emerges from the extrusion nozzle 8. The temperature of the heat transmitting medium at the same time, is maintained at about 20° C. above the melting point of the sodium (97.8° C.) and at least the first and third heating or cooling jacket is supplied with the heat transmitting medium. After that and while maintaining the influx of sodium, cooling is started in order to disperse the heat contained in the melt and the frictional heat in a suitable manner and to bring about the sealing of the worm housing against the environment with a layer of solidified alkali metal.

For this, the first jacket 5 is partially cooled such that solidified or solidifying sodium will build up as a sealing layer at the lead-through openings of the worm shafts 9. The solidifed sodium sets up a resistance as a result of the shaping of the metal against the pressure building up in the extrusion nozzle 8 and thus makes sure of the sealing.

The second jacket 6 is likewise supplied with cooling fluid, which is adjusted such that a temperature gradient occurs between the place of molten alkaline material feed-in and the nozzle section toward the solidifying point of the metal, whereby the temperature will now clearly fall below, preferably by 5°–15° C., the melting point, but only as a result of the dispersing of the melting heat and of the frictional heat occuring in the nozzle 8, via the third jacket 7 now likewise acted upon by coolant.

As a result of the combined heating/cooling procedure described herein it is possible to produce a homogeneous sodium strand. In comparison, a different process was carried out in that before starting of the cooling operation, the preheating of the worm housing as well as the adjusting of the stream of completely liquified alkali metal flowing through the extruder was eliminated. When thusly not operating in accordance with the invention, the sodium overheats in places because of a non-uniform heat discharge and emerges from the nozzle of the extruder in broken, black colored, and partly burning pieces.

The alkali metal leaving the extrusion apparatus, and shaped into a strand of variable diameter and cross-section is fed to an automatic cutting device, and is subdivided into pieces suitable for packaging, in order to accelerate the packaging of the sodium into prepared packages. Optionally, an atmosphere protective gas made be used in this operation.

The following advantages will result from the method of production of the invention, which may be applied to all alkali metals;

1. Continuous shaping of the alkali metal into strands of variable cross sections and dimensions directly from the liquid state;

2. Avoidance of impurities, especially buy operating under inert gas;
3. High through-put performance with low labor costs;
4. Slight wear of extruder.

The invention will be explained further below by an embodiment by way of example.

EXAMPLE

A two shaft extruder was used for extrusion, which consisted of 6 housings with the dimension of 2260 mm of length, 240 mm of width and 240 mm of height.

In order to put the extruder into operation, it was heated with heat transfer oil, until the wall temperature of the extruder reached 120° C. Then, the sodium inlet valve was opened and a constant rate of flow of liquid sodium through the extruder was adjusted. Subsequently, the extruder was subjected to cooling, by first of all, introducing cooling oil into the cooling jacket located before the sodium inlet fed spout in the area of the openings for the shaft of the worm, then the cooling oil was introduced into the second cooling jacket located around the worm housing and finally the cooling oil was introduced into the third jacket located around the extrusion nozzle. The temperature of the inflowing cooling heat transfer oil was about 0° C.; the temperature of the oil leaving the cooling jacket was between 40° and 65° C., depending on the cooling jacket.

In case of an optimal operation of the extrusion apparatus a through-put of 300 kg/h sodium was achieved, whereby the cross section of the strand amounted to 70×70 mm. The armature circuit of the main drive of the apparatus mounted to 150 A at an rmp of the worm of 50 rpm. The torque load was between 60 and 70%. The pressure of the sodium in the extruder just in front of the nozzle rose to about 80 bar. The temperature of the sodium in the space between the worm and the nozzle was around 95° C. As a result of the cooling of the nozzle, the temperature of the sodium strand at the outlet was lowered to 84° C.

We claim:

1. In a process for the production of solid alkali metal strands, the improvement which comprises providing molten alkali metal and introducing the molten alkali metal into a screw extrusion zone containing a double shaft extruder with side-by-side located horizontal worms, running in the same direction and being in mesh, establishing a temperature gradient in said extrusion zone, said gradient ranging from a relatively high temperature at or above the temperature at which the alkali metal is molten, to a relatively low temperature equal to a temperature below the molten point of the alkali metal, the relatively high temperature occurring at the point of introduction of the molten alkali metal to the extrusion zone, and the relatively low temperature occurring at the nozzle in the extrusion zone, moving the alkali metal in a continuous flow through the extrusion zone, cooling the molten alkali metal to a temperature below its melting point, at which temperature the metal is still sufficiently ductile for an extrusion, and feeding the metal to an extrusion nozzle for shaping, and thereafter shaping the metal by passing it through the extrusion nozzle having the required configuration for producing the strands.

2. The process of claim 1, further comprising shaping the alkali metal in an extrusion zone which is first preheated to a temperature at or above the melting point of the metal and subsequently adding liquid alkali metal from a heated supply container, until the metal emerges from the nozzle, then while maintaining the flow of metal, cooling the extrusion zone to thereby obtain a decreasing temperature gradient over the entire length of the extrusion zone to a point where the metal at the nozzle is at the temperature below its melting point.

3. The process of claim 1, further comprising dispersing heat of friction which develops in the nozzle during the process by cooling the nozzle.

4. The process of claim 1, further comprising the extrusion zone being provided with a screw worm shaft and entry point for the screw worm shaft and cooling the extrusion zone at the entry point whereby solidifying a layer of alkali metal which acts to seal the screw worm shaft entry point and prevents contact of air with the alkali metal in the extrusion zone.

5. The process of claim 1, further comprising feeding the shaped alkali metal to an automatic cutting device and cutting it into pieces for packaging.

6. The process of claim 1, further comprising using a protective gas in order to prevent oxidation of the alkali metal.

* * * * *